US007230578B2

(12) United States Patent
Ke et al.

(10) Patent No.: US 7,230,578 B2
(45) Date of Patent: Jun. 12, 2007

(54) DUAL-BAND DIPOLE ANTENNA

(75) Inventors: Yun Long Ke, Tu-Chen (TW); Hsin Kuo Dai, Tu-chen (TW); Lüng-Sheng Tai, Tu-chen (TW); Chin Pao Kuo, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 117 days.

(21) Appl. No.: 11/026,637

(22) Filed: Dec. 30, 2004

(65) Prior Publication Data

US 2005/0243007 A1 Nov. 3, 2005

(30) Foreign Application Priority Data

Apr. 29, 2004 (CN) ..... 2004 2 0268943 U

(51) Int. Cl.
*H01Q 9/16* (2006.01)

(52) U.S. Cl. ..... 343/792; 343/790; 343/793

(58) Field of Classification Search ..... 343/702, 343/790–793, 795, 797, 700 MS
See application file for complete search history.

(56) References Cited

U.S. PATENT DOCUMENTS

| | | | | |
|---|---|---|---|---|
| 4,638,813 | A * | 1/1987 | Turner | 607/154 |
| 6,333,715 | B1 * | 12/2001 | Kato et al. | 343/701 |
| 6,421,024 | B1 | 7/2002 | Stolle | |
| 6,741,220 | B2 * | 5/2004 | Inoue | 343/797 |
| 6,937,204 | B2 * | 8/2005 | Hall | 343/795 |

* cited by examiner

*Primary Examiner*—Tho Phan
(74) *Attorney, Agent, or Firm*—Wei Te Chung

(57) ABSTRACT

A dual-band antenna (1) includes a first antenna (2) and a second antenna (3). The first antenna includes a u-shaped first dipole half (11) and an n-shaped second dipole half (12). The first dipole half is disposed above the second dipole half with a space therebetween and the two dipole halves are mirror imaged. The second antenna includes a u-shaped third dipole half (21) and an n-shaped fourth dipole half (22). The first and the third dipole halves are crossly connected with each other at bottom. The second and the fourth dipole halves are crossly connected with each other at top.

11 Claims, 6 Drawing Sheets

DUAL-BAND DIPOLE ANTENNA

BACKGROUND OF THE INVENTION

1. Field of the Invention

The present invention relates generally to an antenna, and more particularly to a dual-band dipole antenna. The instant application relates to a contemporarily filed application having the same title, the common applicants and the same assignee with the invention.

2. Description of the Prior Art

In recent years, Wireless Local Area Network (WLAN) products under IEEE 802.11a/b/g and Bluetooth standards, such as WLAN cards for computers are gaining popularity in wireless communication market. Wherein, IEEE 802.11b/g and Bluetooth standard is suitable for working at 2.4–2.5 GHz frequency band, while IEEE 802.11a standard is suitable for working at 5–6 GHz frequency band. Many of said WLAN products want to be use under both IEEE 802.11a and IEEE 802.11b/g/Bluetooth standards benefit from dual-band antennas.

For achieving dual-band effect, a dual-band dipole antenna is one of the most mature dual-band antennas in both design and manufacture.

A conventional multi-band dipole antenna is disclosed in U.S. Pat. No. 6,421,024 B1. Said conventional multi-band dipole antenna comprises at least a first antenna having two lower dipole halves, a second antenna having two higher dipole halves and a coaxial cable feeding the first and the second antenna. Each of the dipole halves is formed from an electrically conductive cylindrical tube. Wherein, each upper lower dipole half and corresponding upper higher dipole half are interconnected at a closed top plate. The other lower dipole half and the other higher dipole half are interconnected at a closed bottom plate. The lower dipole halves are jointly operated at a lower frequency band range, while the higher dipole halves are jointly operated at a higher frequency band range. However, the cylindrical tube configuration seems to be complex in structure and must result in a higher cost. Furthermore, the feeder point of the antenna is arranged on the top plate, which is adjacent to the corresponding bottom plate with only a small space remained therebetween. When manufacturing, an inner conductor of the coaxial cable is welded on the bottom plate using a brand iron. The brand iron is so hard to be inserted into the small space that the welding is difficult to be finished.

Hence, in this art, a dual-band dipole antenna with simple structure and low cost, and easy to be manufactured to overcome the above-mentioned disadvantages of the prior art will be described in detail in the following embodiments.

BRIEF SUMMARY OF THE INVENTION

A primary object, therefore, of the present invention is to provide a dual-band dipole antenna with simple structure and low cost for operating in wireless communications under IEEE 802.11a/b/g and Bluetooth standard.

Another object, therefore, of the present invention is to provide a dual-band dipole antenna which is easy to be manufactured, especially easy to be welded.

In order to implement the above object and overcomes the above-identified deficiencies in the prior art, a dual-band antenna comprises a first antenna section configured by first and second plates having conductive surfaces and a second antenna section configured by third and fourth plates having conductive surfaces and electrically insulating with the first antenna section. The first and second plates are arranged in a predetermined angular position and conductively connected with each other and the third and fourth plates are arranged in a predetermined angular position and conductively connected with each other. The first and second plates are both bent at predetermined positions to form a plurality of branches extending in a same direction and the third and four plates are mirror imaged according to the first and second plates.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
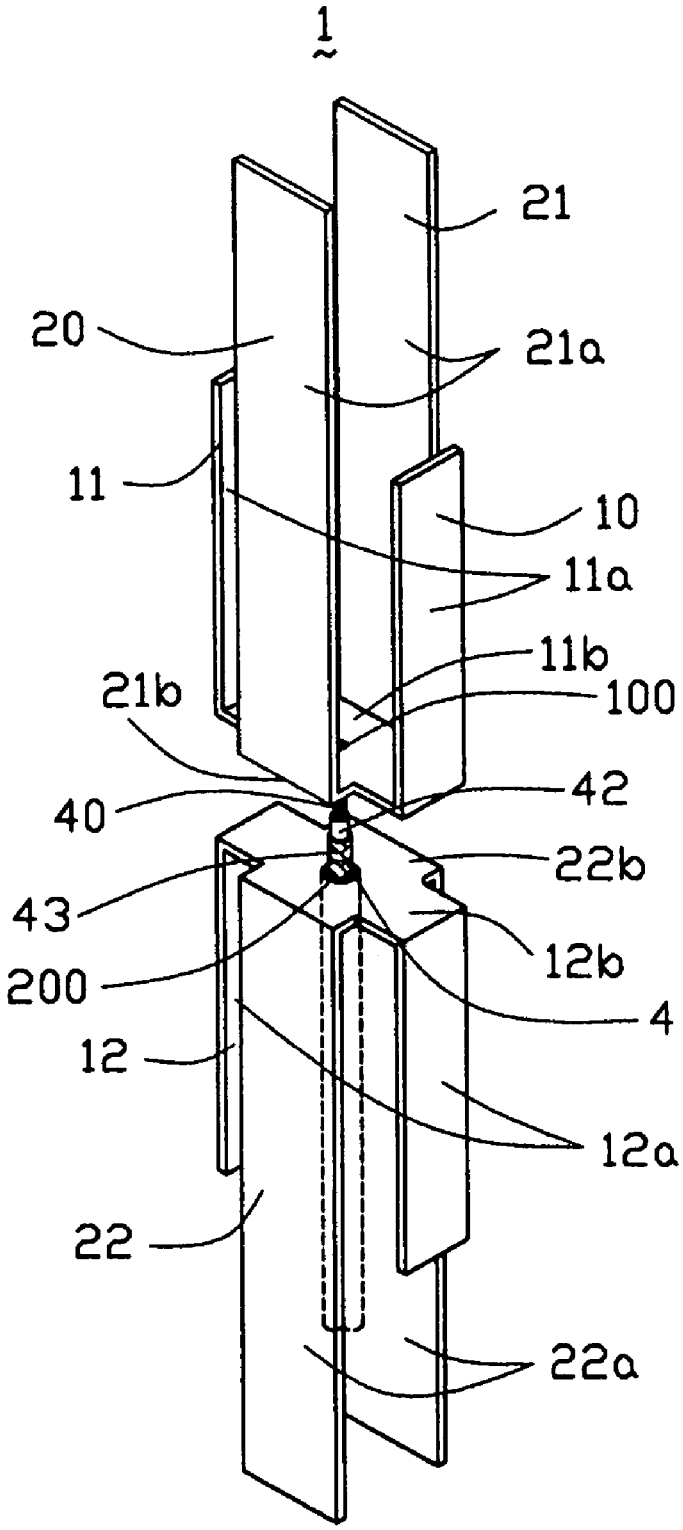
FIG. 1 is a perspective view of a dual-band dipole antenna according to a preferred embodiment of the present invention.

Referring to FIG. 1, a dual-band dipole antenna 1 according to a preferred embodiment of the present invention comprises a first sub-antenna 2, a second sub-antenna 3 and a coaxial cable 4.

The first sub-antenna 2 comprises a first dipole half 11 and a second dipole half 12, which are both made of metal sheets and are symmetrically configured according to a imaginary horizontal plate therebetween. The first dipole half 11 is made of a rectangular plate and bent to form a u-shaped configuration. The first dipole half 11 comprises a first horizontal portion 11*b* laid in a lateral direction and two first branches 11*a* having the same size and respectively extending upwardly in a lengthwise direction perpendicular to the lateral direction from two opposite open ends of the first horizontal portion 11*b*. The second dipole half 12 is made of a rectangular plate and bent to form an n-shaped configuration. The second dipole half 12 comprises a second horizontal portion 12*b* parallel to the first horizontal portion 11*b* and two second branches 12*a* having the same size and respectively extending downwardly in the lengthwise direction from two opposite open ends of the second horizontal portion 12*b*. The first dipole half 11 is rightly located above and corresponding to the second dipole half 12 in the lengthwise direction with an air space therebetween. The first and the second dipole halves 11 and 12 are electrically insulated with each other by the air space.

The second sub-antenna 3 comprises a third dipole half 21 perpendicular to the first dipole half 11 and a fourth dipole half 22 perpendicular to the second dipole half 12. The third and the fourth dipole halves 21 and 22 are both made of metal sheets and symmetrically configured according to said imaginary horizontal plate. The third dipole half 21 is formed of a rectangular plate into a u-shaped configuration and comprises two third branches 21*a* and a third horizontal portion 21*b*. The third horizontal portion 21*b* is coplanar and crossly connected with the first horizontal portion 11*b* adjacent to the second dipole half 12, and defines a feeder point 100 in the middle region thereof. The two third branches 21*a* have the same size and respectively extend upwardly from opposite open ends of the third horizontal portion 21*b*. The fourth dipole half 22 is formed of a rectangular plate into an n-shaped configuration and comprises two fourth branches 22*a* and a fourth horizontal portion 22*b*. The fourth horizontal portion 22*b* is crossly connected with the second horizontal portion 12*b* adjacent to the first dipole half 11 and defines a hole 200 in the central region thereof. The two fourth branches 22*a* have the same size and respectively extend downwardly from two opposite open ends of the fourth horizontal portion 22*b*.

The coaxial cable 4 successively comprises an inner conductor 40, an inner insulator 41, an outer conductor 42 and an outer insulator (not labeled). The coaxial cable 4 is disposed in the lengthwise direction drilling through the hole 200 terminated to the feeder point 100. The coaxial cable 4 is pealed off at one end and revealed the inner conductor 40, the inner insulator 41 and the outer conductor 42. The inner conductor 40 is welded on the feeder point 100 and is electrically connected with the first dipole half 11 and the third dipole half 21. The outer conductor 42 is welded on the second horizontal portion 12*b*, and is electrically connected with the second dipole half 12 and the fourth dipole half 22.

Holistically regarding the dual-band dipole antenna 1 of the present invention, the first and third horizontal portions 11*b* and 21*b* are combinatively formed a connecting portion with a cross-shape. Four branches are respectively extending from four corresponding open ends of the connecting portion. Said connecting portion and said four branches commonly form a radiating portion of the dual-band dipole antenna 1. Wherein, the first dipole half 11 is operated at a higher frequency band, for example, 5.15–5.875 GHz. The third dipole half 21 is operated at a lower frequency band, for example, 2.4–2.5 GHz. The second and the fourth dipole halves 12 and 22 together serve as a grounding portion of the dual-band dipole antenna 1. The coaxial cable 4 feeds the dual-band antenna 1. The first and the second radiating portions 11 and 21 and the grounding portion 12 and 22 are all axially symmetric according to the coaxial cable 4.

Figure 2:
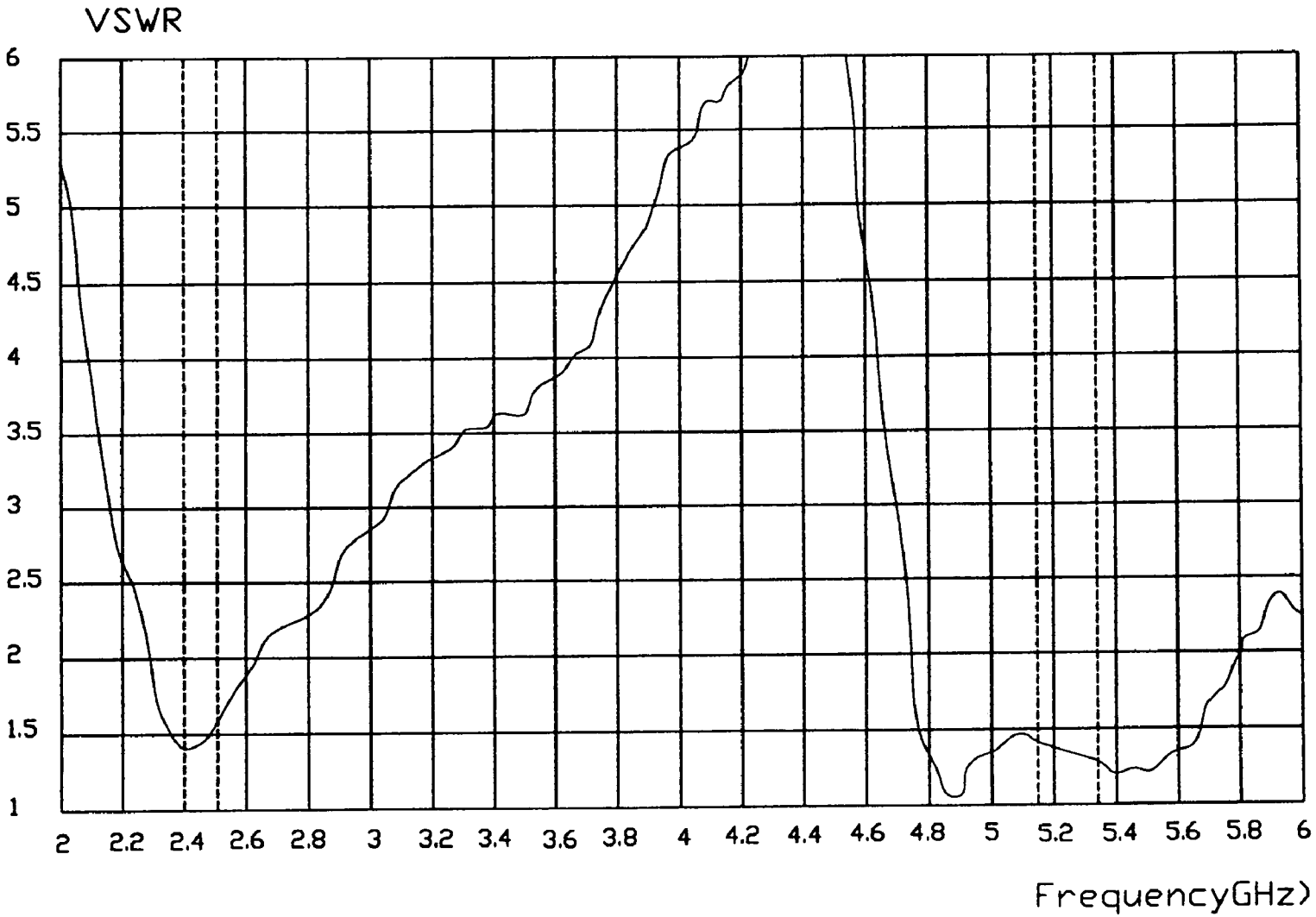
FIG. 2 is a test chart recording to Voltage Standing Wave Ratio of the dual-band dipole antenna according to FIG. 1 as a function of frequency.
Figure 3:
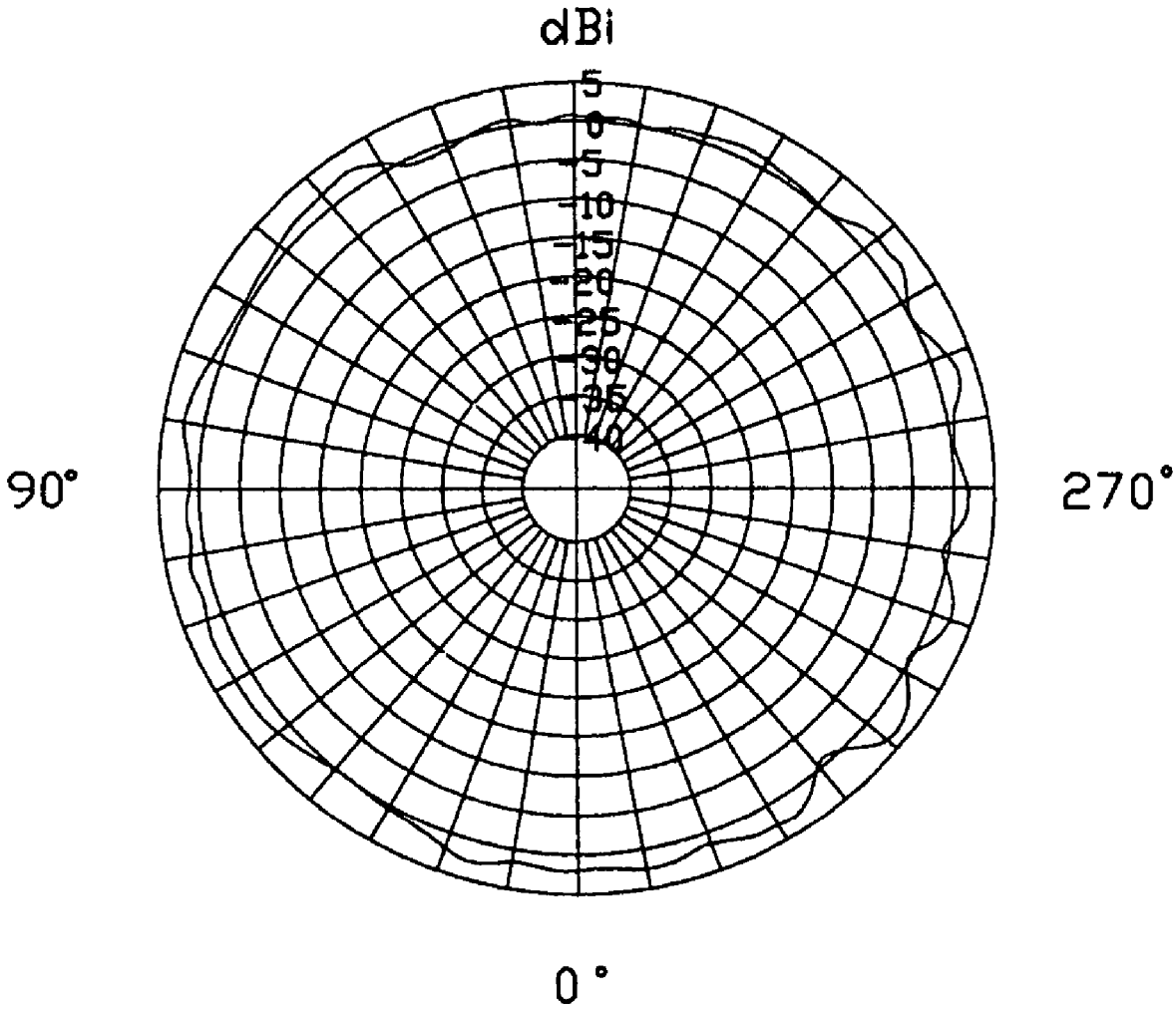
FIG. 3 is a horizontally polarized principle plane radiation pattern of the antenna according to FIG. 1 operating at the resonant frequency of 2.45 GHz.
Figure 4:
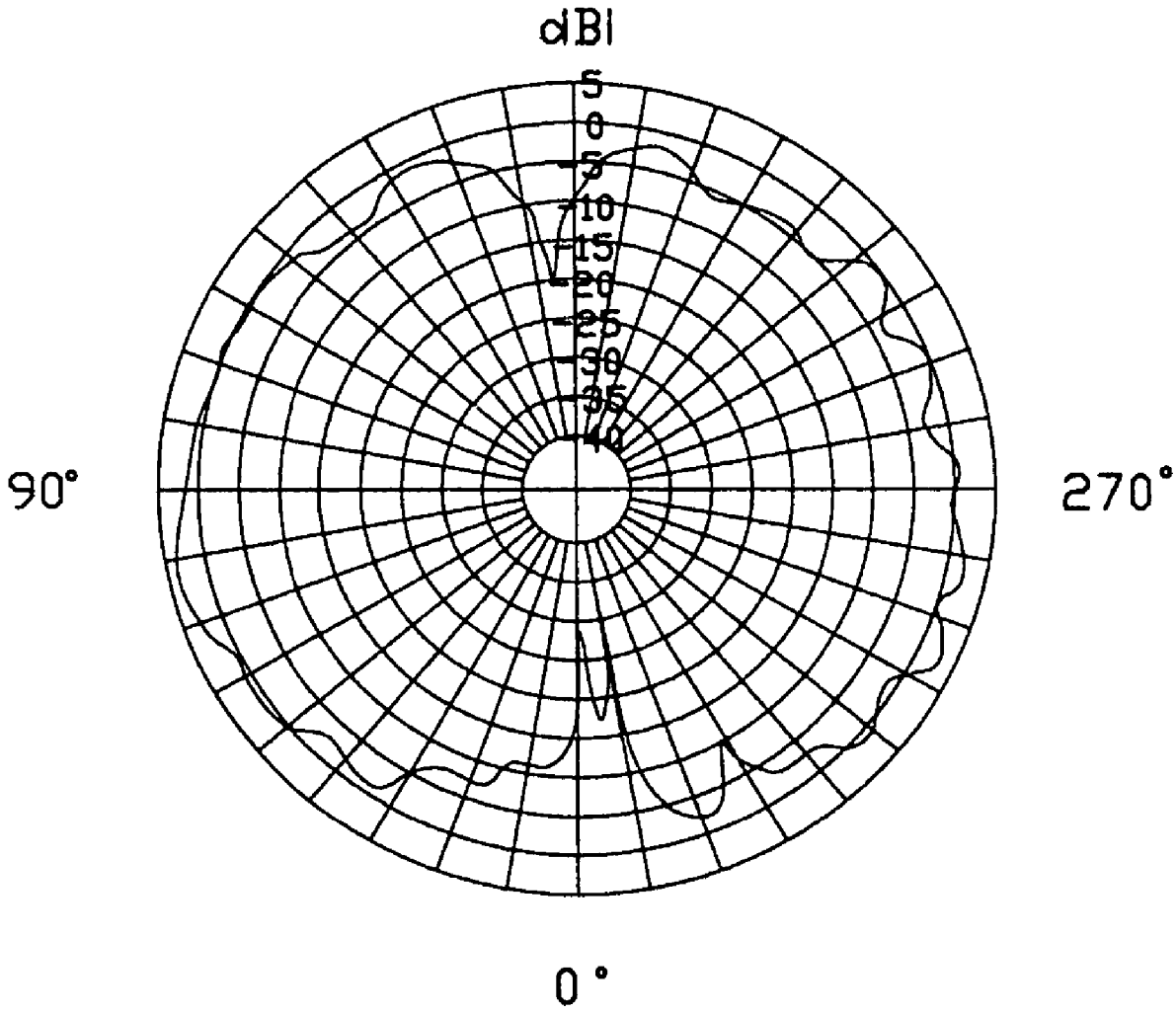
FIG. 4 is a vertically polarized principle plane radiation pattern of the antenna according to FIG. 1 operating at the resonant frequency of 2.45 GHz.
Figure 5:
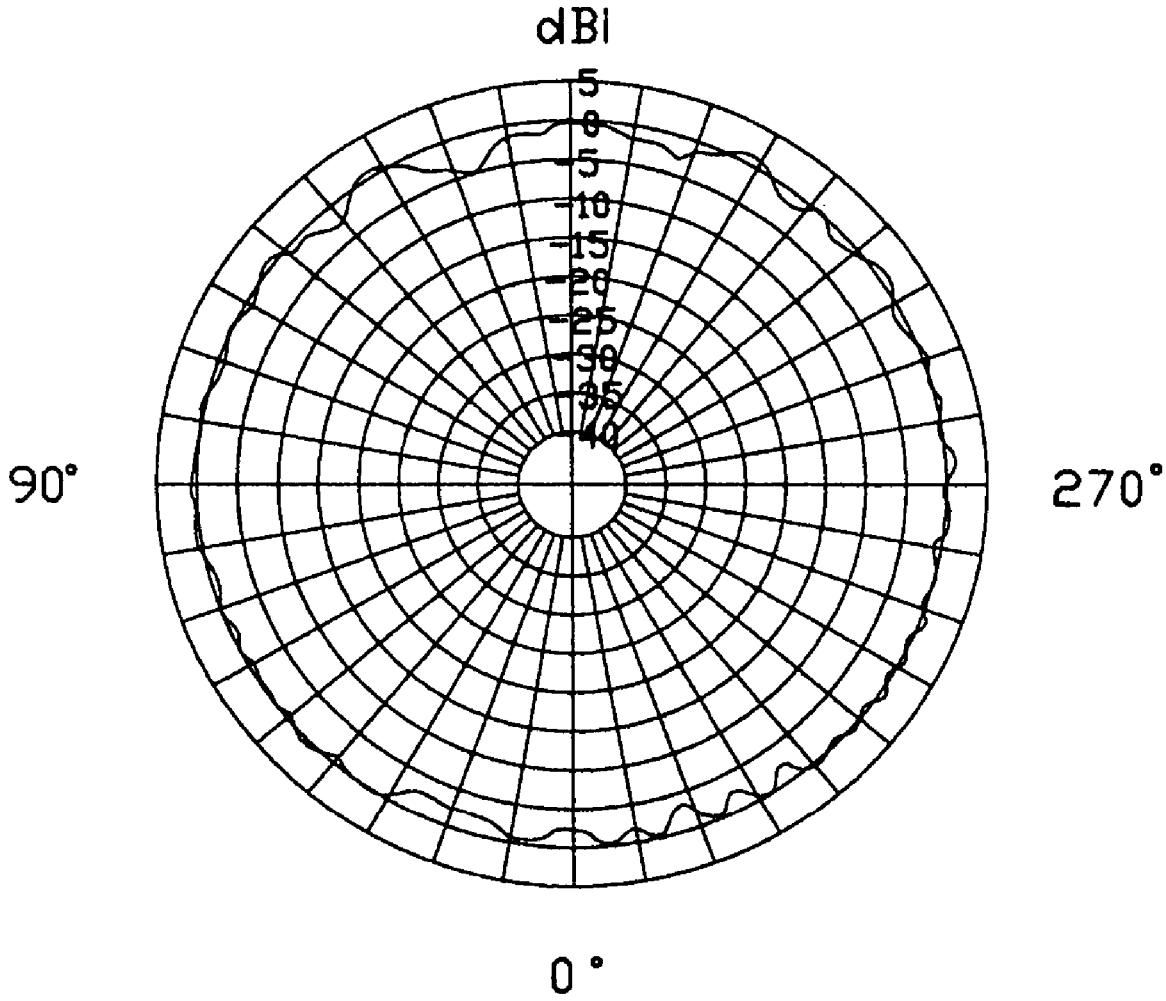
FIG. 5 is a horizontally polarized principle plane radiation pattern of the antenna according to FIG. 1 operating at the resonant frequency of 5.25 GHz.
Figure 6:
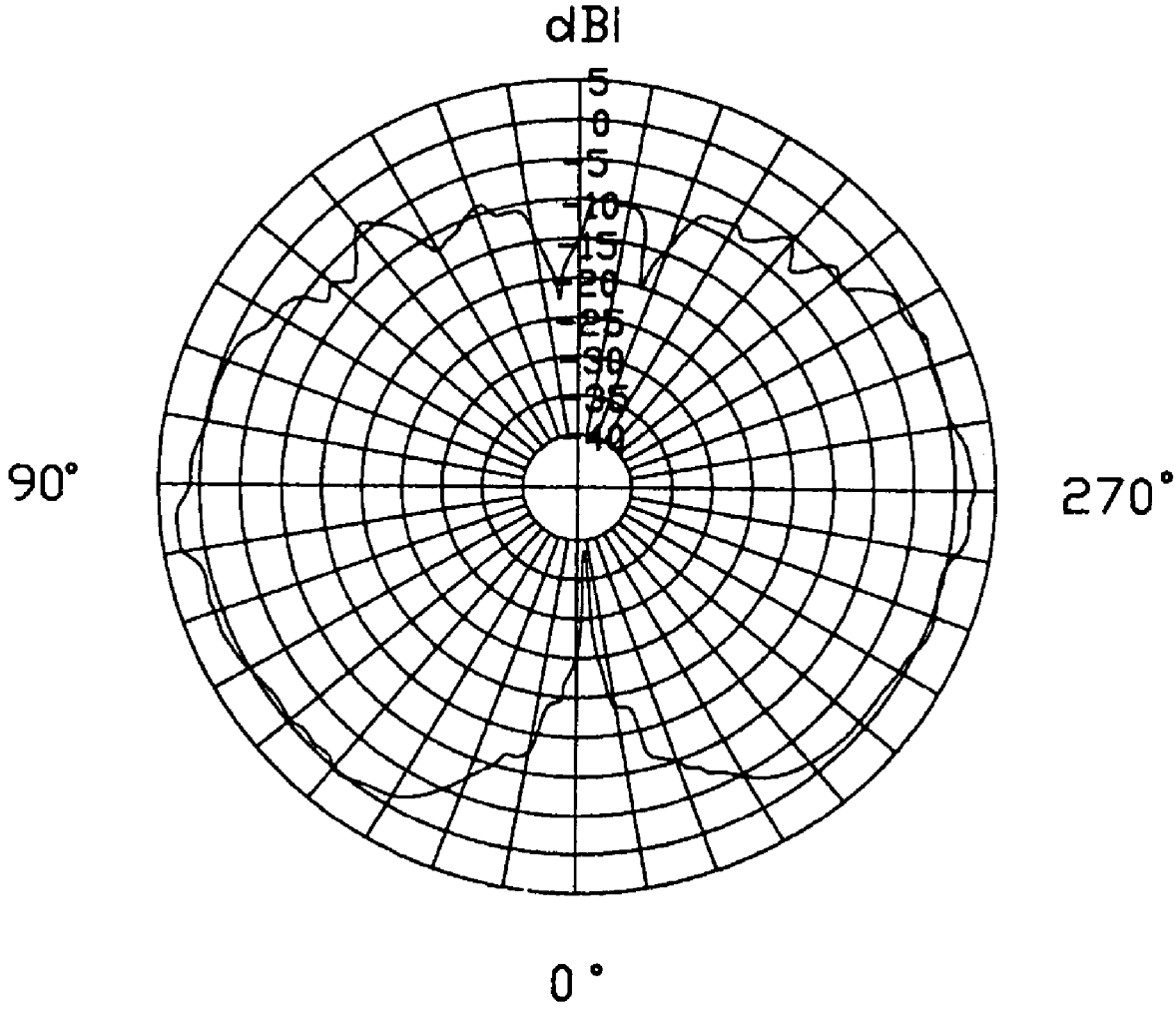
FIG. 6 is a vertically polarized principle plane radiation pattern of the antenna according to FIG. 1 operating at the resonant frequency of 5.25 GHz.

In order to illustrate the effectiveness according to the preferred embodiment of the present invention, FIG. 2 sets forth a test chart recording of Voltage Standing Wave Ratio (VSWR) of the dual-band dipole antenna 1 as a function of frequency. Note that VSWR drops below the desirable maximum value "2" in both 2.3 GHz–2.6 GHz and 5 GHz–6 GHz, indicating a wide frequency bandwidth of 300 MHz in the lower frequency band and a wide frequency bandwidth of 1 GHz in the higher frequency band, which fully cover the bandwidths of wireless communications under IEEE 802.11a/b/g and Bluetooth standards, etc.

FIGS. 3–6 show the horizontally polarized and vertically polarized principle plane radiation patterns of the dual-band dipole antenna 1 operating at the resonant frequency of 2.45 GHz and 5.25 GHz. Note that the each radiation pattern of the antenna 1 is close to corresponding optimal radiation pattern and there is no obvious radiating blind area, conforming to the practical use conditions of an antenna.

In other embodiments, the radiating portion of the dual-band antenna also comprises a connecting portion and a plurality of branches extending from open ends of the connecting portion similar to the antenna according to the first embodiment. Contrastively, the connecting portion is formed of conductive plate having a substantial circle shape, a substantial square shape, a rhombic shape or other shapes besides cross shape by defining slots therein to form a plurality of vicissitudinary offsets extending from the feeder point.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual-band dipole antenna, comprising:

a first sub-antenna comprising a first dipole half having a first horizontal portion and two first branches extending from two opposite ends of the first horizontal portion and a second dipole half having a second horizontal portion and two second branches extending from two opposite ends of the second horizontal portion, wherein the first dipole half and the second dipole half are electrically insulating with each other; and a second sub-antenna comprising a third dipole half having a third horizontal portion and a fourth dipole half having a fourth horizontal portion and electrically insulating with the third dipole half;

wherein the first and the third horizontal portions are crossly connected with each other, and the second and the fourth horizontal portions are crossly connected with each other.

2. The dual-band dipole antenna as claimed in claim 1, wherein the first and the second sub-antennas are both fed by a coaxial cable.

3. The dual-band dipole antenna as claimed in claim 2, wherein the second dipole half and the fourth dipole half are both axially symmetric according to the coaxial cable.

4. The dual-band dipole antenna as claimed in claim 1, wherein the first and the second dipole halves are minor imaged, and the third and the fourth dipole halves are symmetrically configured.

5. The dual-band dipole antenna as claimed in claim 1, wherein the third dipole half further comprises two third branches extending from two opposite ends of the third horizontal portion and the fourth dipole half timber comprises two fourth branches extending from two opposite ends of the fourth horizontal portion.

6. The dual-band dipole antenna as claimed in claim 5, wherein the first branches, the third branches and the first horizontal portion are perpendicular to each other.

7. A dual-hand antenna, comprising:

a first antenna section configured by first and second plates having conductive surfaces, the first and second plates are arranged in a predetermined angular position and conductively connected with each other; and a second antenna section electrically insulating with the first antenna section; wherein the first and the second plates are both bent at predetermined positions to form a plurality of branches.

8. The dual-band antenna as claimed in claim 7, wherein the plurality of branches all extend in a same direction.

9. The dual-band antenna as claimed in claim 7, wherein the second antenna section is configured by third and fourth plates having conductive surfaces, said third arid fourth plates being arranged in a mirror-image disposition with respect to the first and second plates.

10. The dual-band antenna as claimed in claim 7, wherein the first plate and the second plate share a same conjunction area, which a feeder cable is electrically connected to and which divides each of said first plate and said second plate into two equal parts.

11. The dual-band antenna as claimed in claim 10, wherein the first antenna section and the second antenna section are mirror-imaged with each other relative to an imaginary plane located therebetween and parallel to said conjunction area.

* * * * *